United States Patent [19]

Van Der Avoort

[11] Patent Number: 4,872,863

[45] Date of Patent: Oct. 10, 1989

[54] METHOD OF FIXING A CATHODE-RAY TUBE CONE AND DISPLAY WINDOW PRIOR TO SEALING AND A CATHODE-RAY TUBE MANFACTURED BY SUCH A METHOD

[75] Inventor: Henricus J. M. Van Der Avoort, Eindhoven, Netherlands

[73] Assignee: U.S. Philips Corporation, New York, N.Y.

[21] Appl. No.: 202,616

[22] Filed: Jun. 6, 1988

[30] Foreign Application Priority Data

Jun. 11, 1987 [NL] Netherlands ..... 8901356

[51] Int. Cl.[4] ..... H01J 9/30; H01J 9/26

[52] U.S. Cl. ..... 445/45; 313/482

[58] Field of Search ..... 445/23, 25, 44, 45; 430/23; 313/364, 461, 476, 477, 482

[56] References Cited

U.S. PATENT DOCUMENTS

| | | | |
|---|---|---|---|
| 2,484,345 | 10/1949 | Hinz | 313/482 |
| 2,514,976 | 7/1950 | Stivin | 445/44 |
| 2,565,327 | 8/1951 | Shaw | 313/482 |
| 2,744,207 | 5/1956 | Sessions | 313/477 |
| 3,978,562 | 9/1976 | Palac | 445/45 |
| 4,010,525 | 3/1977 | Baur et al. | 445/45 |
| 4,591,344 | 5/1986 | Palac | 445/45 |
| 4,713,034 | 12/1987 | Lee et al. | 445/45 |
| 4,758,763 | 7/1988 | Gorton | 313/482 |

*Primary Examiner*—Kurt Rowan

*Attorney, Agent, or Firm*—John C. Fox

[57] ABSTRACT

The invention relates to a method of manufacturing a cathode-ray tube in which a cone part and a display window are accurately positioned relative to each other, a glass frit is provided between the display window and the cone part, and the positioning thus obtained is fixed by securing locating pins to faces on the display window and in slots in studs on the cone by means of an acrylate adhesive. Subsequently, the display window is permanently secured to the cone by frit sealing.

4 Claims, 3 Drawing Sheets

METHOD OF FIXING A CATHODE-RAY TUBE CONE AND DISPLAY WINDOW PRIOR TO SEALING AND A CATHODE-RAY TUBE MANFACTURED BY SUCH A METHOD

BACKGROUND OF THE INVENTION

The invention relates to a method of manufacturing a cathode-ray tube, in which a cone having a edge and a substantially rectangular display window having a substantially rectangular sealing edge are positioned relative to each other and subsequently sealed to each other at the location of the sealing edge and the cone edge.

The invention further relates to a cathode-ray tube manufactured by such a method.

In the mass-production of cathode-ray tubes a number of parts, amongst others cones and display windows, are produced according to predetermined dimensions and configurations, after which a number of these parts are selected to be secured to each other. In order to obtain properly functioning cathode-ray tubes, it is necessary that the parts selected are accurately positioned relative to each other before being secured to one another. To position the cone and display window of a cathode-ray tube, prior to sealing use can be made of several reference systems. A commonly used reference system is described in U.S. Pat. 4,373,237. In this patent, reference surfaces are ground on the cone part and reference points are provided at the periphery of the display window. When the display window is positioned on the cone part, the reference points of the display window and the reference surfaces of the cone are referenced to a common reference. In this manner the display window is accurately positioned relative to the cone part. Other reference systems are described in, amongst others, German Offenlegungsschrift 2850602 and Netherlands Specifications 7909155 and 7304115 which are laid open to Public Inspection.

In general the display window is sealed to the cone edge at the location of the sealing edge by means of a glass frit provided on the cone edge before the display window and the cone are positioned relative to each other. After the display window has been accurately positioned on the cone, both are led through a sealing oven having a predetermined temperature schedule, where the glass frit is recrystallized, causing the display window and the cone to be sealed to each other in a vacuum-tight manner. In the course of this sealing process, temperature differences occur in the cathode-ray tube which cause tensile stresses in the cathode-ray tube. This may adversely affect the accurately adjusted positioning of the display window relative to the cone part.

SUMMARY OF THE INVENTION

It is an object of the invention to provide a method of manufacturing a cathode-ray tube, by which the accurately adjusted positioning of the display window relative to the cone part can be retained during the sealing process.

To this end, a method of the type mentioned in the opening paragraph is characterized in that after the two parts have been positioned relative to each other, this positioning is fixed temporarily prior to the sealing process by temporarily fixing the two parts together by securing locating pins to faces which are provided on the peripheral edge of one of the parts, each locating pin being secured in a slot which is provided on a stud present on the peripheral edge of the other part.

By temporarily fixing the adjusting positioning of the display window and the cone, this positioning is retained during the sealing process.

In a preferred embodiment of a method according to the invention, each locating pin is secured to a face and in a slot by means of an acrylate adhesive. Since an acrylate adhesive forms a proper bond in nor more than a few seconds, the production time of a cathode-ray tube is hardly influenced.

During the warming-up period of the sealing process the acrylate adhesive may burn, depending upon the type that is used. If this takes place before the cone is sealed to the display window, the adjusted positioning of the display window relative to the cone may still be adversely affected. To prevent this, a further preferred embodiment of the method according to the invention provides for each locating pin to be secured to a face and in a slot by means of a temperature resistant cementing agent. This cementing agent dries out completely during the warming-up period of the sealing process, and immediately after the acrylate adhesive is burned it takes over the fixing of the display window and the cone. Since the temperature resistant cementing agent dries out completely, the locating pins are permanently fitted in the slot of the stud.

A further preferred embodiment of the method according to the invention provides two studs, having one slot each, on the peripheral edge of one of the long sides of one of the substantially rectangular parts, and two faces on the corresponding side of the other part and provides one stud, and one face, respectively, on the peripheral edges of one of the short sides of the parts. In practice it has been found that three locating pins are sufficient to fix the accurate positioning of the two parts relative to each other during the sealing process.

A cathode-ray tube manufactured by means of the method according to the invention exhibits an accurate positioning of the display window relative to the cone and operates satisfactorily.

BRIEF DESCRIPTION OF THE DRAWINGS

The invention will now be explained in more detail in terms of several exemplary embodiments and with reference to the drawings, in which.

DESCRIPTION OF THE PREFERRED EMBODIMENTS

Figure 1:
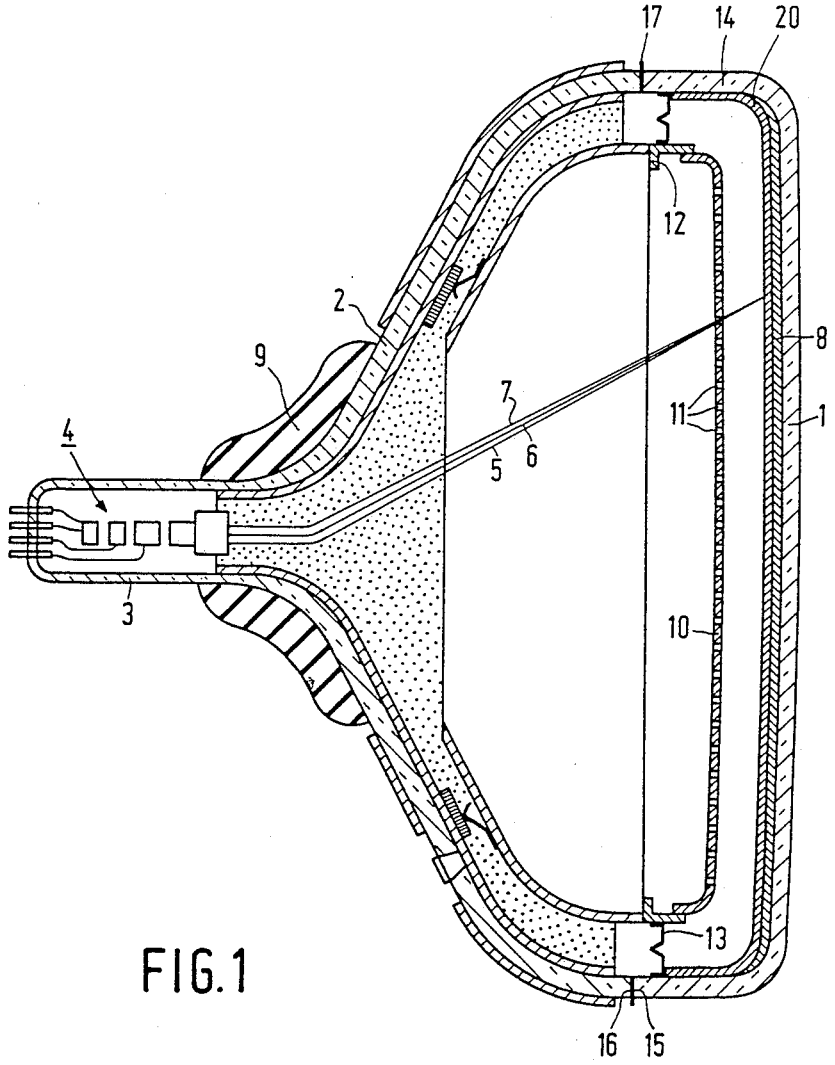
FIG. 1 is a sectional view of a cathode-ray tube.

The cathode-ray tube shown in a horizontal sectional view in FIG. 1 comprises an envelope consisting of a substantially rectangular display window 1, and a cone 2 having a substantially rectangular cone edge 16, and a neck 3. In the neck 3 there is provided an electrode system 4 having three electron guns for generating three electron beams 5, 6 and 7. The electron beams are generated in one plane (in this case the plane of the drawing), and they are focused on a picture screen 8 which is provided on the inside of the display window 1, which picture screen 8 consists of a large number of phosphor elements, which are coated with an aluminium layer 20, and which emit red, green or blue light. The phosphor elements may be in the form of, for example, strips or dots. By way of example, the invention will be further described in terms of strip-like elements, whose longitudinal direction is perpendicular to the plane through the electron beams. On their way to the picture screen 8, the electron beams 5, 6 and 7 are deflected by means of a number of deflection coils 9 which are coaxially arranged about the axis of the tube, the beams passing through a shadow mask 10 consisting of a metal plate with apertures 11, the longitudinal direction of which is parallel to the phosphor elements of the picture screen 8. The three electron beams 5, 6 and 7 pass through the apertures 11 at a small angle with respect to one another, and consequently, are incident on only one colour strip each. The shadow mask 10 is secured to a framework 12 which is suspended in the cathode-ray tube from the upright edge 14 of the display window 1 by suspension means 13. The upright edge 14 of the display window is provided with an edge 15, the so-called sealing edge. To obtain a properly functioning cathode-ray tube, the cone 2 and the display window 1, which are generally manufactured separately, should be properly positioned relative to each other before they are sealed to each other. In the manufacture of a cathode-ray tube it is customary to first provide the display window 1, with, amongst others, the picture screen 8, the aluminium layer 20, the suspension means 13 and the shadow mask 10. The display window 1 is then positioned against the cone 2 with an intermediate glass frit 17 between the sealing edge 15 and the cone edge 16. Before sealing the display window 1 to the cone 2, these two parts must be accurately positioned relative to each other. This positioning of the two parts relative to each other can be carried out in various known ways, one of them being described in, U.S. Pat. No. 4,373,237. When both parts have been accurately positioned relative to each other, they are led through a sealing oven and are sealed to each other by the glass frit.

Figure 2:
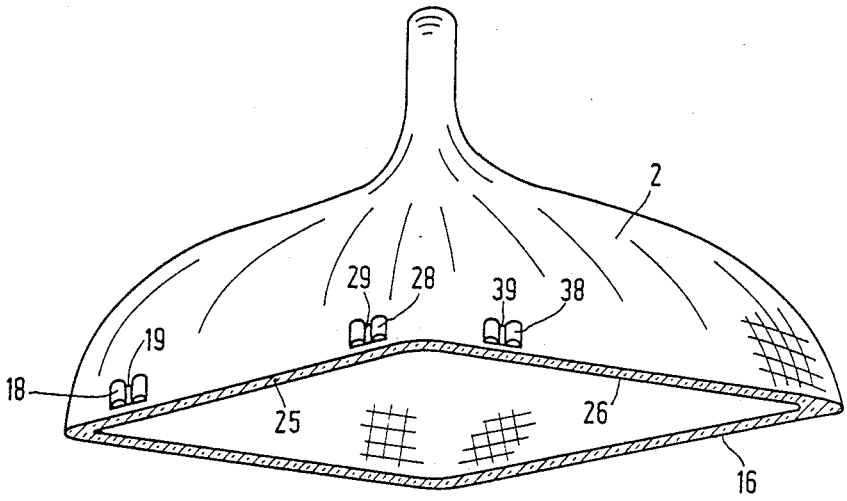
FIG. 2 is a perspective view of a cathode-ray tube cone having studs provided with a slot, according to the invention.
Figure 3:
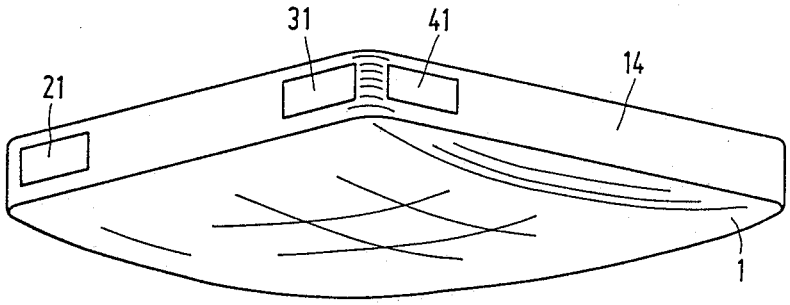
FIG. 3 is a perspective view of a display window having faces, according to the invention.

According to one embodiment of the invention, the adjusted accurate positioning is retained during the sealing process, by providing the cone 2 with a number of studs 18, 28 and 38 which are each provided with a slot 19, 29 and 39, respectively, as is shown in perspective in FIG. 2. The studs 18, 28 and 38 may be made separately of a material having a coefficient of thermal expansion which is substantially equal to that of the cone part 2. The studs 18, 28 and 38 may, however, also be pressed or otherwise formed as an integral part of 2. The upright edge 14 of the display window 1 comprises faces 21, 31 and 41 as shown in FIG. 3. These faces can simply be plain portions of the upright edge 14 of the window 1.

Figure 4:
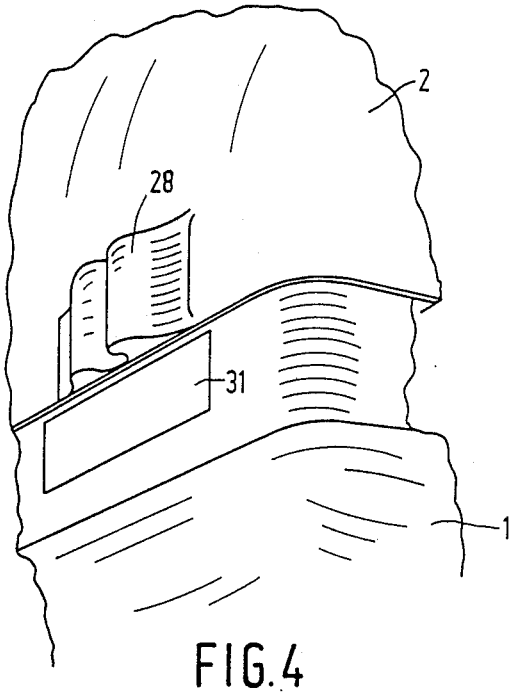
FIG. 4 is a detailed perspective view of a part of the cone and the display window of FIGS. 2 and 3 which are positioned relative to each other.
Figure 5:
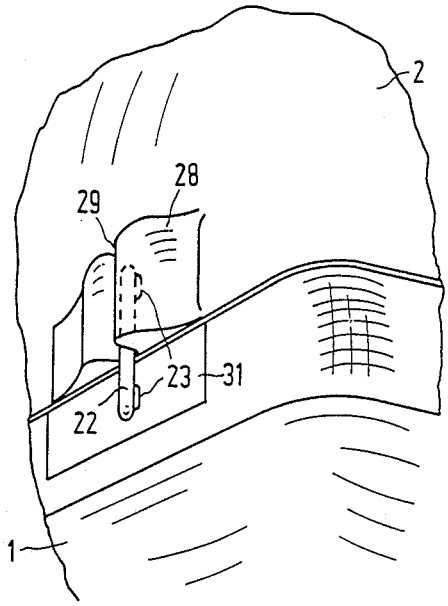
FIG. 5 is a view similar to that of FIG. 4, showing fixing the position of the display window relative to the cone by means of pins, according to the invention.
Figure 6:
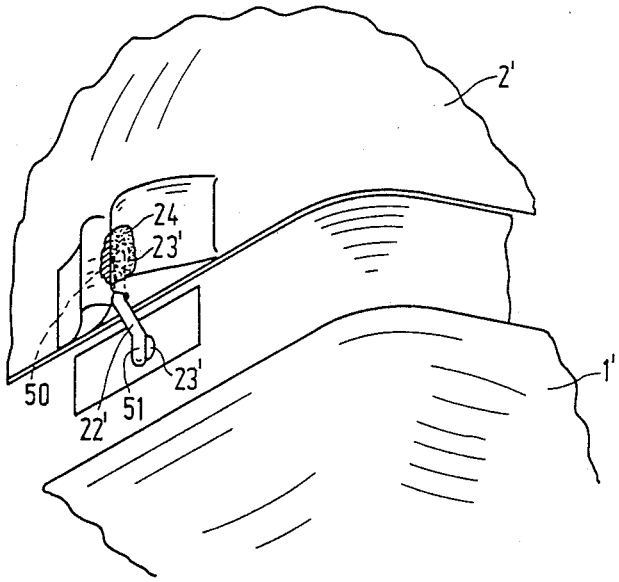
FIG. 6 is a view similar to that of FIG. 5 showing a different way of fixing the position of the display window relative to the cone by means of pins, according to the invention.

Two studs 18 and 28, each having a slot 19 and 29, respectively, are provided on the peripheral edge of a long side 25 of the substantially rectangular cone edge 16, and one stud 38 having a slot 39 is provided on the peripheral edge of the short side 26 of the cone edge 16. Analogously, the faces 21, 31 and 41 are positioned on the periphery of the upright edge 14 such that they and the studs 18, 28 and 38 are juxtaposed when the cone part 2 is accurately positioned relative to the display window 1, as is shown in FIG. 4 for the face 31 and the corresponding stud 28. For the sake of clarity FIG. 4 does not show the glass frit present between the display window 1 and the cone 2. In practice it has been found that the accurate positioning can suitably be fixed by securing three locating pins to the faces and in the slots, as is shown in FIG. 5 for one locating pin 22 on the face 31 and in the corresponding slot 29. The locating pin 22 is, for example, a metal rod whose coefficient of thermal expansion is about equal to that of the glass from which the display window 1 is made. A suitable metal is, for example, a Cr-Fe alloy containing 28% of Cr. Preferably, the locating pin 22 is secured to the face 31 and in the slot 29 by means of a drop of acrylate adhesive 23, such that the accurately adjusted positioning of the display window 1 relative to the cone 2 is fixed after no more than a few seconds. Once the relative positioning has been fixed, the cathode-ray tube can be led through a sealing oven. A commonly known sealing process which consists of a number of temperature schedules makes sure that the display window is permanently sealed to the cone by means of a glass frit. During the warming-up stage of this sealing process the acrylate adhesive may burn, depending upon the type used. This might adversely affect the accurately adjusted positioning. To avoid this, the locating pin 22' is preferably embedded in a temperature resistant cement 24 after it has been secured to the display window 1' and the cone part 2' by means of an acrylate adhesive 23', which temperature resistant cement 24 dries out completely during the warming-up stage of the sealing process and takes over the fixing of the display window 1 and the cone part 2 immediately after the acrylate adhesive 23' has burned, as is shown in FIG. 6. When, for example, Loctite Cyanoacrylate 496 (Trade mark) is used as an acrylate adhesive, a suitable temperature resistant cement is, for example, Aremco 571 A+B (Trade mark). After the display window and the cone have been permanently secured to each other, the locating pins and the studs are no longer required and may be removed by grinding.

The locating pin may have several shapes, for example, a straight rod 22 as is shown in FIG. 5, or a locating pin 22' as is shown in FIG. 6, having eccentric portion. One end 50 of such a locating pin 22' is introduced into the slot. By rotating the pin 22', the end 51 of the locating pin is made to lie against the face.

In order to protect a cathode-ray tube against implosion, a clamping band is usually provided around the upstanding edge of the display window forward of the location where the display window and the cone are secured to each other.

Dependent upon the type, size and location of clamping band used as a protection against implosion, the locating pins can be fixed such that they do not have to be removed after the display window has been permanently secured to the cone part.

It will be obvious that the present invention is not limited to the above-described embodiments, but that within the scope of the invention many variations are possible to those skilled in the art. For example, it is alternatively possible to secure the studs with the slot to the display window and to secure the faces to the cone part, and it is possible to vary the number of locating pins used.

What is claimed is:

1. A method of manufacturing a cathode-ray tube, including the steps of positioning relative to each other and subsequently sealing to each other a cone part having a substantially rectangular cone edge and a display window part having a substantially rectangular sealing edge at the location of the sealing edge and the cone edge, characterized in that after both parts have been positioned relative to each other this positioning is fixed temporarily prior to sealing by securing locating pins to faces which are provided on the peripheral edge of one of the parts, each locating pin being secured in a slot which is provided on a stud present on the peripheral edge of the other part, each locating pin being secured to a face and in a slot by means of an acrylate adhesive, and also secured to a face and in a slot by means of a temperature resistant cement.

2. A method as claimed in Claim 1, in which two studs, having one slot each, are provided on a long side of one of the substantially rectangular parts, two faces are provided on the corresponding side of the other part, and one stud, having one slot, and one face, respectively, are provided on the peripheral edges of one of the short sides of the substantially rectangular parts.

3. A cathode-ray tube manufactured by the method as claimed in Claim 1.

4. A cathode-ray tube containing a cone part having a substantially rectangular edge and a display window part having a substantially rectangular sealing edge, the parts sealed together at the edges, characterized in that the cathode-ray tube is provided with locating pins which are secured in slots of studs which are provided on the peripheral edge of one of the parts, and which locating pins are secured to faces which are provided on the peripheral edge of the other part, each locating pin being secured to a face and in a slot by means of an acrylate adhesive, and also secured to a face and in a slot by means of a temperature resistant cement.

* * * * *